US005487491A

United States Patent [19]

Smith et al.

[11] Patent Number: 5,487,491

[45] Date of Patent: Jan. 30, 1996

[54] CARTRIDGE DISPENSER WITH INTERIOR BAG AND INTERLOCKING LID

[75] Inventors: Ernest L. Smith, Kansas City, Mo.; Joseph A. Pantelleria, Overland Park, Kans.

[73] Assignee: Sealright Company, Inc., Kansas City, Mo.

[21] Appl. No.: 235,098

[22] Filed: Apr. 29, 1994

Related U.S. Application Data

[63] Continuation-in-part of Ser. No. 71,966, Jun. 7, 1993, Pat. No. 5,348,196.

[51] Int. Cl.[6] ..... B65D 35/28

[52] U.S. Cl. ..... 222/95; 222/153.07; 222/327

[58] Field of Search ..... 222/95, 327, 386, 222/570, 153, 153.07

[56] References Cited

U.S. PATENT DOCUMENTS

| | | | |
|---|---|---|---|
| 1,695,104 | 12/1928 | Huntley . | |
| 1,727,257 | 9/1929 | Stratton et al. . | |
| 2,055,602 | 9/1936 | Dodge . | |
| 2,485,142 | 10/1949 | Duncan . | |
| 2,684,791 | 7/1954 | Sebell . | |
| 2,751,073 | 6/1956 | Sheeran . | |
| 2,927,543 | 3/1960 | Sherbondy . | |
| 3,373,898 | 3/1968 | Witzgall . | |
| 3,373,899 | 3/1968 | Witzgall . | |
| 3,815,787 | 6/1974 | Spies | 222/95 |
| 3,884,396 | 5/1975 | Gordon et al. . | |
| 4,027,810 | 6/1977 | Van Manen . | |
| 4,117,951 | 10/1978 | Winckler | 222/95 X |
| 4,326,650 | 4/1982 | Van Manen . | |
| 4,356,935 | 11/1982 | Kamin . | |
| 4,676,406 | 6/1987 | Frischmann et al. . | |
| 5,088,630 | 2/1992 | Arch et al. . | |
| 5,330,074 | 7/1994 | Wirsig et al. | 222/95 X |
| 5,348,196 | 9/1994 | Smith et al. | 222/327 X |

*Primary Examiner*—Gregory L. Huson

*Attorney, Agent, or Firm*—Kokjer, Kircher, Bowman & Johnson

[57] ABSTRACT

A dispensing canister for viscous fluids, such as sauces at a fast food outlet. The container includes a peripheral side wall formed of cardboard or other inexpensive material. The side walls are maintained in their proper configuration, and made more rigid, by the use of rigid rings applied to the longitudinal ends thereof. A first end of the container is closed by a plunger which is mounted within the interior of the container side walls and forms the bottom of the container. A trailing edge of the plunger is received within the ring at this first end, to be securely maintained in position. A lid is applied to close the second end of the container. The lid includes a downward depending skirt having a catch portion which engages with the rolled ring at this second end. A dispensing nozzle is formed in the lid. A bag is located within the container with the opening folded over the sidewall beneath cap. The bag may be located intermediate the end ring and the sidewall, or intermediate the end ring and the cap, to maintain the bag in position. Movement of the plunger collapses the bag to force material contents of the bag from the nozzle in the cap.

21 Claims, 3 Drawing Sheets

CARTRIDGE DISPENSER WITH INTERIOR BAG AND INTERLOCKING LID

CROSS-REFERENCE TO RELATED INVENTIONS

This application is a Continuation-in-Part of U.S. Ser. No. 08/071,966, filed Jun. 7, 1993, now U.S. Pat. No. 5,348,196, which is incorporated herein by reference.

BACKGROUND OF THE INVENTION

1. Field of the Invention

The present invention relates in general to canisters for the storage of fluid or semi-fluid materials. In particular, the present invention relates to an improved canister for such materials which includes an integral plunger which may be moved through the container body to extrude the fluid or semi-fluid material from the container.

2. Description of the Related Art

It has been known to provide containers for material having a low viscosity, such as semi-solid or semi-frozen liquid food stuffs which provide a dispensing feature. This is particularly prevalent in the field of sauces and other materials for use in fast food outlets. Such containers typically include an elongated container body having a dispenser opening or spout at a first end and a movable sealing plunger at the second end. The container is placed within an appropriate device for holding the container and the plunger is moved towards the first end containing the spout. This movement of the plunger forces the material within the container through the spout for dispensing. Examples of such containers are shown in U.S. Pat. Nos. 2,927,543 to Sherbondy, 3,884,396 to Gordon, et al., 4,326,650 to Van Manen, and 4,356,935 to Kamin.

One of the concerns with such containers is container integrity, especially at the rear, plunger end of the container. In the prior art devices a poor seal about the periphery of the plunger will allow moisture and air to pass into the container, causing contamination or spoilage of the material to be dispensed. Additionally, an poor plunger seal will allow the material to pass between the plunger and the container side wall, reducing the amount of material which may be dispensed and creating a cleanup and spoilage problem.

One arrangement to provide a better plunger seal is shown in U.S. Pat. No. 4,027,810 to Van Manen. This reference shows a plunger having a soft resilient material surrounding a rigid core. The soft material conforms to the interior of the container to provide an effective seal. While the sealing characteristics of this plunger are adequate, the two-part construction raises the cost of the container.

Additional factors which raise the cost of such dispensing containers, and make them less attractive, are the junctions between the plunger and the container in the initial position of the plunger, the junction between the container side wall and the lid of the container and the initial seal across the dispensing spout. To provide adequate seals against contamination and leakage, these junctions and seals are typically of a complicated nature requiring several assembly steps. This of course increases the cost of such containers.

SUMMARY OF THE INVENTION

An object of the present invention provide a canister which allows the storage and dispensing of a viscous fluid material.

Another object of the present invention is to provide such a canister which may be easily filled with the material, and which may easily dispense the material.

A further object of the present invention is to provide such a canister which effectively resists leaking of the material stored therein.

Another object of the present invention is to provide such a canister which includes a movable plunger forming one end of the canister, with this plunger having an effective seal against the interior of the container side wall.

Yet another object of the present invention is to provide such a canister which includes a liquid impermeable flexible bag within the sidewalls to receive the material, and a movable plunger mounted to collapse the bag and eject the material.

Yet another object is to provide such a container in which the plunger may be easily and securely retained in its initial position.

Yet another object of the present invention is to provide a lid at a second end of the container which may be applied thereto in a single step, yet is securely retained thereon.

Yet another object of the present invention is to provide such a lid Which includes a dispensing nozzle which is securely closed during storage, yet may be easily opened for use.

A further object of the present invention is to provide such a canister having the interior bag in which the lid retaining means further retains the bag.

These and other objects are achieved by a cartridge-type dispensing canister for viscous fluids, such as sauces at a fast food outlet. The cartridge includes a peripheral side wall formed of cardboard or other inexpensive material. The side walls are maintained in their proper configuration, and made more rigid, by the use of rigid rings applied to the longitudinal ends thereof. A first end of the container is closed by a plunger which is mounted within the interior of the container side walls and forms the bottom of the container. A trailing edge of the plunger is received within the ring at this first end, to be securely maintained in an initial position. The plunger is formed as a monolithic unit and includes projecting ridges which scrape against the interior of the side walls as the plunger is moved towards a second end of the container. A lid is applied to close the second end of the container. The lid includes a downward depending skirt having a catch portion which engages with the rolled ring at this second end. This allows the lid to be applied by a simple downward motion with no ancillary steps required. A dispensing nozzle is formed in the lid and includes a punchout which initially closes the nozzle. A reduced thickness line allows the punchout to be easily removed for dispensing. The lid may be formed as a monolithic unit, such as by injection molding. A flexible bag may be received within the sidewall to hold the material. The bag will collapse as the plunger is moved forward. The open end of the bag may be retained at the second end of the container by the rolled ring, or the lid skirt.

BRIEF DESCRIPTION OF THE DRAWINGS

The objects and features of the invention noted above are explained in more detail with reference to the drawings in which like reference numerals denote like elements, and in which.

DETAILED DESCRIPTION OF THE INVENTION

Figure 1:
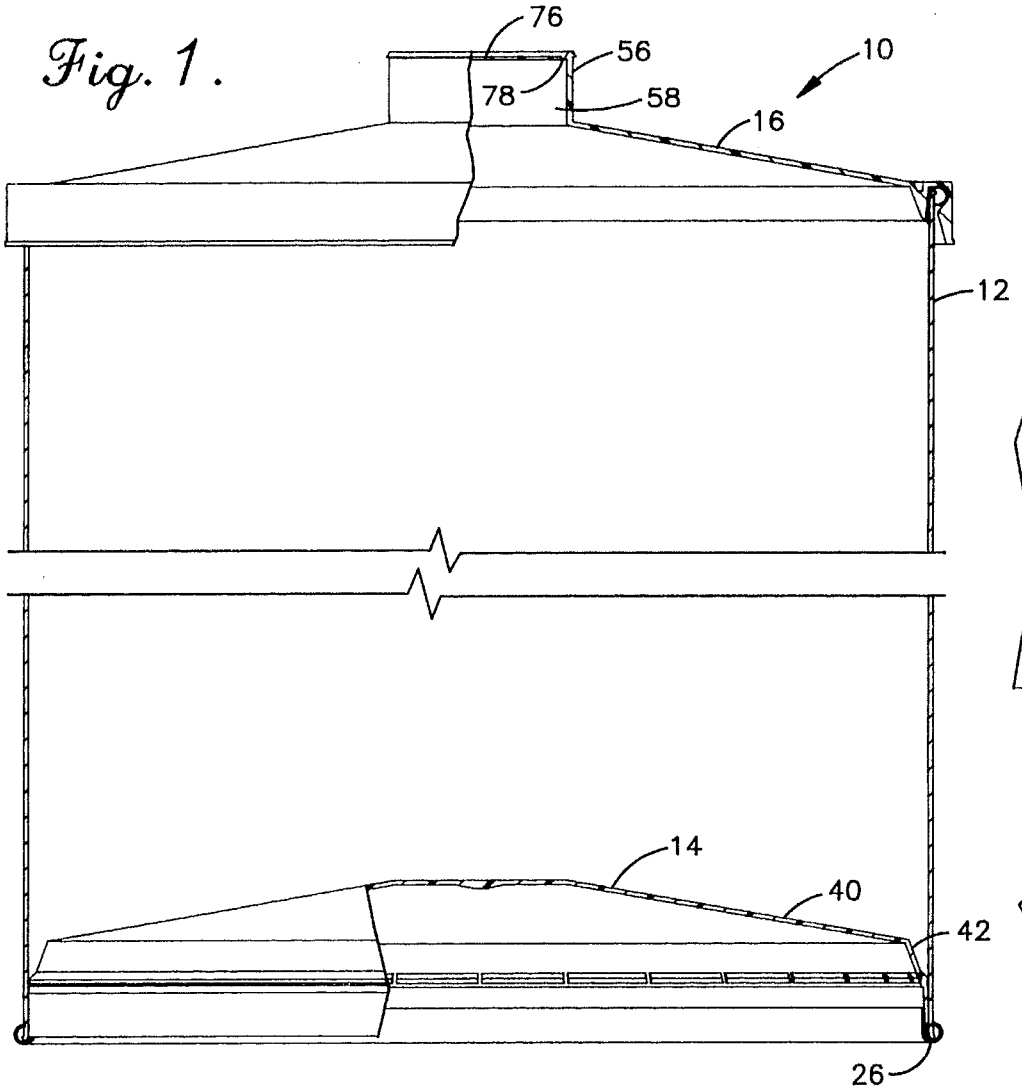
FIG. 1 is a side view, in partial cutaway of a container according to the present invention.

With reference to FIG. 1, a cartridge-type container according to the present invention is generally designated by reference numeral 10. The container 10 generally consists of a side wall 12, plunger 14 and cap 16.

Figure 2:
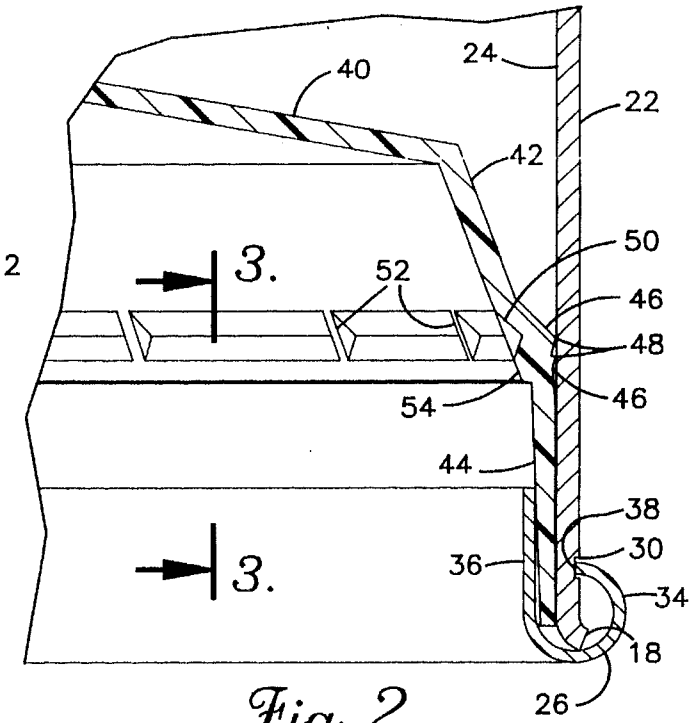
FIG. 2 is a detail view in cross-section showing the plunger in the initial position.
Figure 4:
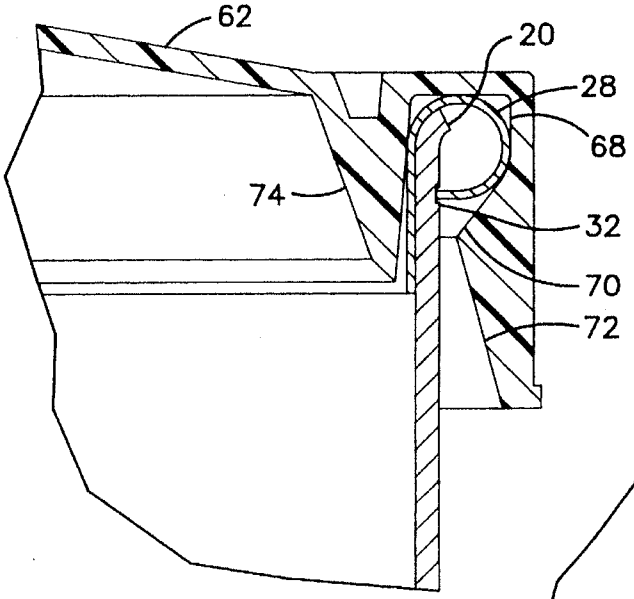
FIG. 4 is a detail view in cross-section showing the attachment of the lid to the side wall.

The side wall 12 defines a closed periphery extending between a first edge 18 (FIG. 2) and a second edge 20 (FIG. 4). The side wall 12 may be formed of a variety of materials and be formed into a variety of cross-sectional configurations, but is preferably formed of spiral wound paper and formed into a cylinder. The closed periphery of the side wall defines an exterior face 22 and an interior face 24 (FIG. 2). Depending upon the material to be placed within the container 10, the interior face 24 may be provided with a plastic coating or laminate to form a barrier between the product and the side wall. A wax coating may also be employed, but is not preferred for reasons discussed below.

Mounted upon the first and second edges of the side wall are first and second end rings 26 and 28, respectively. Specifically, the exterior face of side wall 12 is provided with first and second ring grooves 30 and 32, each spaced from an associated one of the edges 18 and 20. Each of the ring grooves extends about the periphery of the side wall 12. Each of the end rings 26 and 28 also extend about the entire periphery of the side wall, and include a rolled portion 34 and a substantially straight portion 36, in cross-section.

The rolled portion 34 extends from a first edge 38, received within the respective one of the ring grooves 28 or 30, and curves about to encompass the respective first or second edge 18 or 20. The rolled portion 34 transitions into the straight portion 36 at an appropriate tangential point on the rolled portion such that the straight portion 36 extends substantially parallel to the side wall 12. As is best shown in FIG. 4, the second end ring 28 is formed such that the straight portion 36 (and a portion of the rolled portion 34) are in abutment with the interior face 24 of the side wall 12. The arrangement of the first end ring 26 will be explained below.

The end rings are preferably formed of metal such that they may be fixed upon the side wall 12 by plastic deformation. This deformation is sufficient to ensure that the rings are tightly held about the side wall 12, with the first edge 38 urged toward the straight portion. Additionally, the placement of the first edge 38 within the respective ring grooves 30 and 32 restricts movement of the rings away from the side wall in the longitudinal direction. The use of the end rings provides a structural soundness to the side wall 12 and helps to maintain the side wall configuration, as is known in the art. However, in the present invention the end rings are additionally employed for other purposes.

A first example of this is the restraint of the plunger 14 within the container. The plunger 14 includes at its innermost end, with respect to the container, a domed portion 40. The domed configuration provides structural strength to the plunger 14 but is not strictly necessary. For example, the domed portion could be formed as a substantially .planar portion with appropriate reinforcement ribs, if necessary. The domed portion includes an outer periphery which substantially corresponds to that of the side wall 12. Connected to the outer periphery of the domed portion 40 is a transition portion 42. The transition portion preferably extends towards the first edge 18 to compliment the domed portion 40. Extending downward from a lower end of the transition portion 42 is a skirt 44. The skirt 44 extends towards the first edge 18, such that the entire plunger has a concave configuration towards this first edge. To reduce material costs, it is preferred that the plunger have a substantially uniform thickness, such that this concave configuration is also present on the underside or exterior side of the plunger.

The skirt 44, being essentially an extension of the domed portion 40, has a peripheral configuration substantially corresponding to that of the side wall 12. The skirt 44 preferably has a close sliding tolerance with the interior face 24 of the side wall. This will help to ensure that air and moisture do not ingress into the container to contaminate the product therein, and that the product will not pass between the skirt 44 and the interior face of the side wall during use. As such, skirt 44 assists in forming a seal for the plunger 14.

The formation of the seal is assisted by the presence of one or more peripheral ribs 46 formed on the exterior of the plunger 14 at a position intermediate the transition portion 42 and skirt 44. As is best shown in FIG. 2, each of the ribs 46 is substantially triangular in cross-section and includes a crown or apex 48 spaced peripherally outward with respect to the immediately adjacent portions of the plunger 14. The crowns of the ribs may extend peripherally outward of all portions of the plunger 14, including the skirt 44, or may have an outer periphery substantially corresponding to that of the skirt. Either arrangement will ensure that the crowns of the ribs are in very close sliding engagement with the interior face 24 of the side wall 12. As such, the crowns of the ribs will act as scrapers to help ensure that product does not pass behind the plunger 14, and will additionally act as seals to ensure that moisture and air do not enter the container.

Where the plunger is formed with the preferred substantially constant thickness, the ribs 46 extending peripherally outward with respect to immediately adjacent sections of the plunger will result in corresponding depressions in the underside face of the plunger, as illustrated by groove 50. Such grooves may provide a point for the concentration of stresses which could cause failure of the plunger material.

Figure 3:
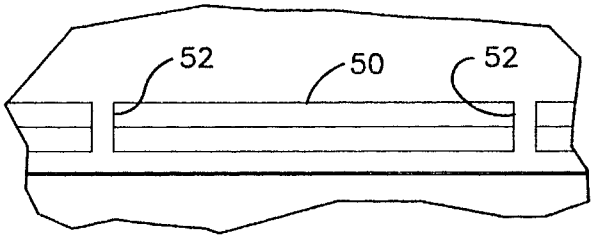
FIG. 3 is a detail view along lines 3—3 of FIG. 2.

To prevent such failure the plunger may be provided with a plurality of reinforcing ribs 52 which extend across the groove 50, as best shown in FIG. 3. Alternatively, a thickened portion may be provided in the area corresponding to ribs 46. Such a thickened portion may conveniently take the form of a continuation of the underside face from the transition portion 42. It is also possible to provide both of these structures 52 and 54 within a single plunger 14. This is best shown in FIG. 2 where the plunger maintains a substantially constant thickness for the uppermost of the peripheral ribs 46, with the interior of the plunger being provided with ribs 52 across the resulting groove 50, and a thickened portion 54 is formed in the area of the lower peripheral rib 46.

A second example of an additional use for the end rings is the retention of the cap 16. The cap 16 includes a neck 56 or other arrangement to provide an opening 58 therethrough to provide an exit for the contents of the container 10. Where a neck 56 is employed, it may be desirable to form an outward peripheral lip 60 in proximity to the free end of the neck such that the peripheral lip will serve to maintain a conduit for the contents in position upon the neck.

Connected to and supporting the neck 56 is a main body 62 which extends from the neck 56 to the sidewall 12 of the container. The main body preferably has a shape in the form of a frustrum of a cone for increased strength, although other configurations are possible. The main body includes an outer periphery 64 which corresponds substantially to that of the sidewall 12.

Connected to the outer periphery 64 is engagement means for connecting the cap 16 to the second end ring 28. This engagement means may take the form of a peripheral skirt 66 which extends in a direction from the second end ring to the first end ring. The cap 16 is formed to rest in the applied position with the undersurface of the main body 62 in close proximity to the second end ring 28. As such, the skirt 66 includes a first portion 68 adjacent the main body 62 which has an outer peripheral length substantially equal to that of the outer most portion of end ring 28, such that this first portion may be located peripherally outward of the end ring. A second portion 70 of the skirt 66 is located below (i.e., in the direction of first end ring 26) the first portion 68. This second portion has a reduced peripheral length such that this second portion is spaced at least somewhat peripherally inward with respect to the outermost portion of end ring 28, such that this second portion forms a catch which may retain the skirt, and thus the cap 16, in position upon the end ring 28.

It is preferred that the skirt 66 be formed of a material with sufficient resiliency that the second portion 70 may be bent peripherally outward to allow the cap to be placed upon the end ring 28, yet will return to its original position to extend inward of the end ring and thus retain the cap in place. To assist in this placement of the cap upon the end ring, it is preferred that the skirt additionally include a third portion 72 located downward with respect to the second portion 70. The third portion 72 will provide a substantially smooth transition from the reduced periphery of the portion 70 to the lower end of the skirt 66, which has a peripheral length greater than that of second portion 70. As such, this third portion 72 will act as a camming surface to aid in the outward expansion of the skirt 66 to allow the second portion 70 to pass over the ring 28.

While this arrangement may be sufficient for some purposes, it is preferred that the cap 16 be provided with means for forming a better seal with the end ring 28. To this end, the cap 16 is provided with a sealing lip 74 extending downward from the main body 62 and spaced inward from the skirt 66 about the entire periphery of the main body 62. The spacing of the sealing lip from the skirt in preferably substantially equal to the width of the second end ring 28, such that the first portion 68 of the skirt 66 and the outer peripheral face of the sealing lip 74 will both be in contact with the end ring 28. This arrangement, in conjunction with the possible contact of the main body 62 upon the upper portion of the end ring 28, will provide a sufficient seal for a wide variety of contents. As with the third portion 72 of the skirt, the outer peripheral face of the sealing lip may taper peripherally inwardly towards the first end ring 26 to aid in placement of the cap over the-second end ring 28.

To reduce costs and increase the integrity of the container 10, the cap 16 may be formed as a monolithic plastic element, formed for example by injection molding. As may be readily envisioned, this will allow the caps 16 to be easily mass produced at extremely low unit costs. Additionally, since the cap is a monolithic unit there is no danger of leakage through the cap, as there are no joints.

It should also be apparent that the configuration of the present cap allows it to be easily assembled to the sidewall 12 by a simple downward movement. This is an extremely simple process and does not require complicated machinery as in the prior art. In certain situations, the cap may of course be applied by hand, and this simple assembly allowed by the cap construction facilitates the manual application of the cap.

Where the cap is formed as a monolithic unit a closure for the opening 58 may be advantageously formed as an integral portion of the cap 16. For example, FIG. 1 shows a punch out 76 in the form of a planar element extending across and blocking the opening 58. This punch out 76 is a monolithic portion of the remainder of the cap 16. A reduced thickness line 78 is formed about the juncture of the neck 56 and punchout 76, such that the reduced thickness line may act as a tear line for removal of the punch out 76. The punch out would be removed at the final destination of the container just prior to dispensing of the contents therefrom.

Figure 5:
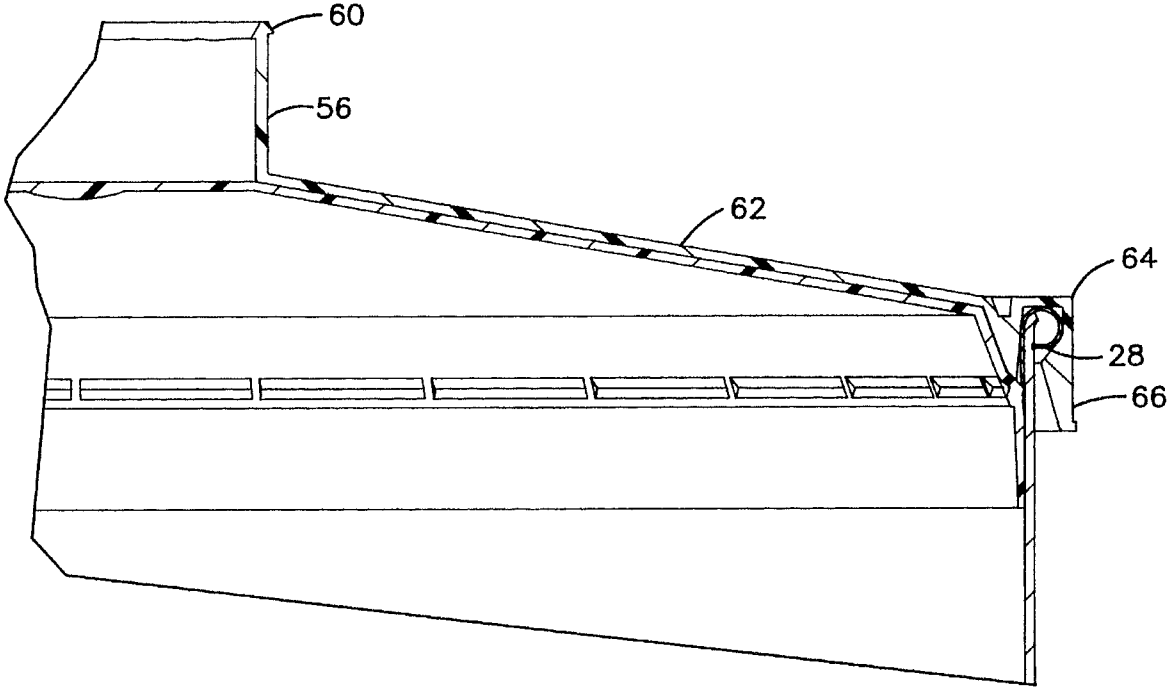
FIG. 5 is a detail view in cross-section showing the plunger in its final position.

To ensure that the maximum amount of the contents are dispersed from the container, it is additionally preferred that the cap 16 and plunger 14 are so configured to define a mating relationship when in contact, so that there are few if any voids between these elements which may act as reservoirs for material not dispensed. As is best shown in FIG. 5, the frustoconical configuration of the main body 62 of the cap may correspond to the domed portion 40 of the plunger 14. Additionally, the peripherally inner face of the sealing lip 74 may mate with the transition portion 42 of the plunger, and possibly some or all of a face of the uppermost peripheral rib 46.

The construction and operation of the container according to the present invention will now be described. Initially, a plurality of the caps and plungers are mass produced, and a quantity of the material forming the sidewall and end rings is also produced. These materials are then transferred to the packing sight. Employing an assembly machine of known design, the material forming the sidewall 12 is formed into a tube and the end rings 26 and 28 are applied thereto. The plunger 14 is placed in position prior to attachment of the first end ring 26, such that the plunger is retained in position by this end ring, as shown in FIGS. 1 and 2. At this point the container will have a sidewall and a bottom (formed by the plunger 14) and is sufficiently ridged to receive the contents of the container. Upon receipt of the contents within the container, the cap 16 is applied by a simple downward pressing motion, thus completing the container 10.

The container is been transferred to the intended sight for use, where it may undergo a period of storage. During this time the monolithic nature of the cap and plunger, and the seal provided between the plunger and sidewall, and cap and second end ring, assures that the contents will be maintained in a fresh condition. When the container is ready for use, the user will take a sharp object and remove the punch out 76 by tearing along the reduced thickness line 78.

Once the punch out 68 has been removed a conduit or hose (if employed) may be connected to the neck 56. The container may then be placed in an appropriate device having a ram to apply pressure to the plunger 14 to move the plunger towards the cap 16. This movement will of course reduce the volume of the container, thus forcing the contents of the container to pass through the opening 58. As the plunger is moved towards the cap 16 it is dislodged from its position intermediate the straight portion 36 of the first end ring 28 and the sidewall 12. By virtue of the ring groove 30 and the nature of the material employed to form the second end ring 28, this straight portion 36 will move towards the sidewall 12 and the first end ring 26 will thus be maintained in position.

The plunger will continue to move towards the cap 16 with continued application of pressure, causing extrusion of the contents of the container, until it is placed in abutment against the cap 16. During this movement, the contents of the container apply pressure to the cap 16 in a direction tending to force it to be removed from the sidewall 12. However, the use of the skirt 66 ensures that the cap will be retained in position. When the plunger has reached the abutting position with the cap 16, the mating nature of the cap and plunger ensures that a maximum amount of the material has been displaced. This is also aided by the peripheral ribs 46 which scrape along the interior sidewalls 12 during movement of the plunger, ensuring that the contents of the container are not contaminated nor wasted.

Figures 6, 7, 8:
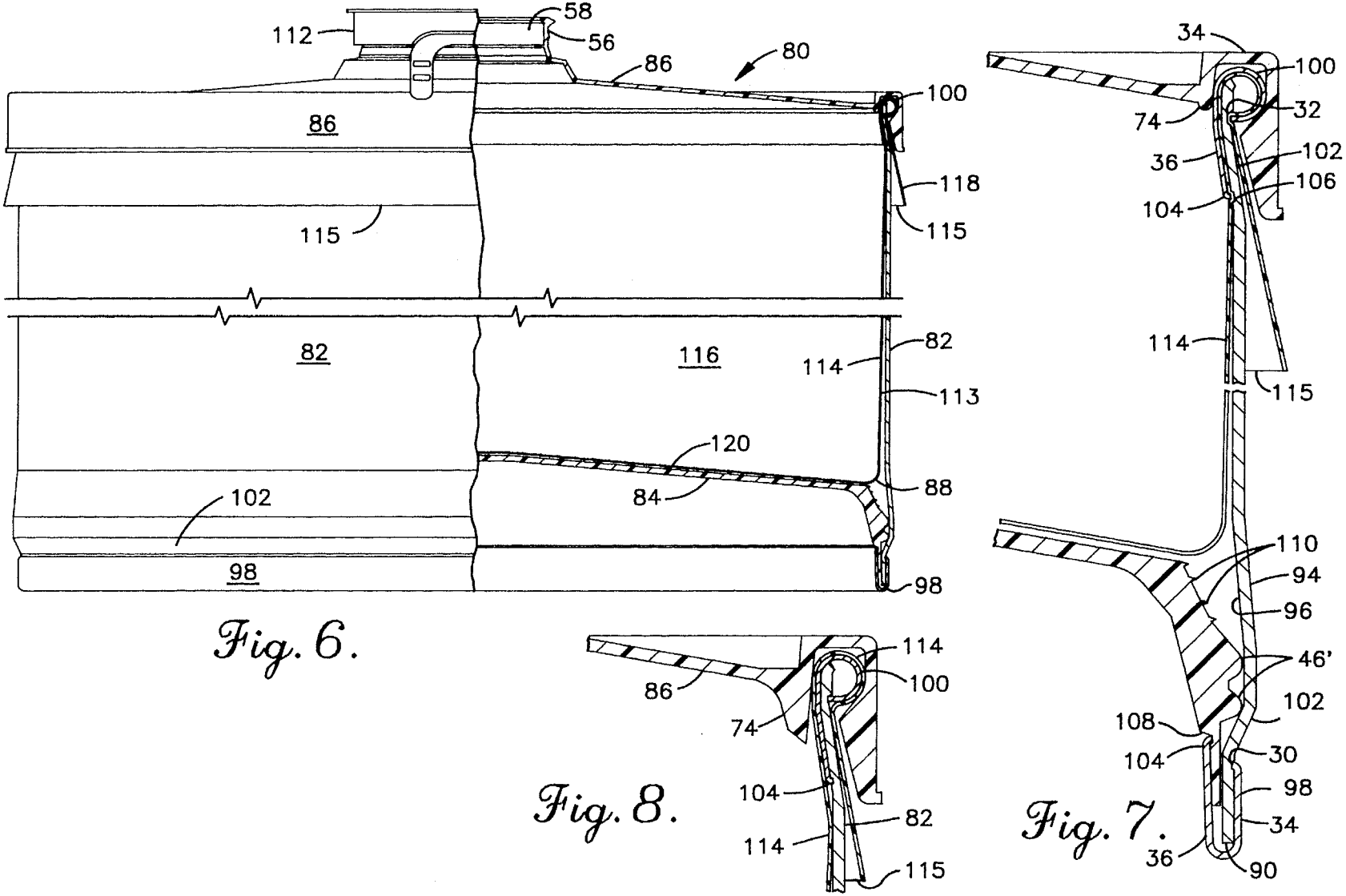
FIG. 6 is a detail side view in partial cross-section of a second embodiment having an interior bag.
FIG. 7 is a detail cross-sectional view showing a first arrangement for retaining the bag.
FIG. 8 is a detail cross-sectional view showing a second arrangement for retaining the bag.

With reference to FIGS. 6–8 a second embodiment of the present invention will be described, with this container being generally designated by reference numeral 80. Container 80 generally consists of a side wall 82, plunger 84, cap 86, and bag 88.

The side wall 82 again defines a closed periphery (typically circular) extending between a first edge 90 (FIG. 7) and second edge 92 (FIG. 8), and includes an exterior face 94 and an interior face 96 (FIG. 7). The side wall may be formed similar to the first embodiment, although the interior face will typically not require any laminations or coatings to form a barrier.

As with the first embodiment, there are first and second end rings 98 and 100 mounted upon the first and second edges, respectively. In contrast with the first embodiment, however, it is preferred that the rings have an outer diameter approximately less than or equal to that of the sidewall 82, and to this end, tapers 102 are formed in the side wall at each of the edges 90 and 92. The tapers may be formed by several methods, such as by pleating the material of the sidewall either before or during application of the end rings, by reduced side wall material length at the ends of the sidewall, or by other means.

The tapers are preferably of a sufficient extent that the outer diameter of the side wall between the tapers is generally equal to the outer diameter of the cap 86, and first ring 98. This will result in the container 90 more closely fitting within the intended receptacle during use. This will provide a more secure assembled condition within the receptacle, and will serve to optimize the amount of material provided within each container.

The first end ring 98 is generally similar to that of the first embodiment. One exception from the first embodiment is a flattening of the rolled section 34, such that it conforms more closely to the sidewall. This flattening will reduce somewhat the strength provided by the addition of the end ring, but also reduces the diameter of the end ring, thus reducing the amount of taper required at the second end. A further exception is the provision of an interior hook 104 on the free end of the straight section 36. Since the straight section 34 of the first end ring does not initially contact the side wall (when the plunger is in the initial position), the interior hook 104 of the second end ring is received within a hook groove 108 formed in the plunger, as more fully described below.

The second end ring 100 is again generally similar to that in the first embodiment, with two exceptions. The first is that the straight portion 36 may include a slight outward cant to take into account the taper 102 at the second end. The second exception is an interior hook 104 at the edge of this straight portion. The interior hook extends into an interior ring groove 106 on the interior face of the side wall, spaced from the first edge. Like the ring grooves 30 and 32, this ring groove extends about the interior periphery of the side wall, and receipt of the hook within this groove serves to further secure the second end ring to the second edge.

It is noted that it is possible to simply form the hook 104 upon the second end ring and cause the hook to press into the interior face of the side wall upon attachment of the ring, thus eliminating the need to form a separate interior ring groove by a separate step.

The end rings are formed or applied as in the first embodiment, and again, serve to provide structural soundness to the side wall as well as serving the other functions enumerated.

For example, the first end ring again serves to restrain the plunger 14 within the container. The plunger 14 of this second embodiment is generally similar to the first, in that it includes a domed portion 40, transition portion 42 and skirt 44. There are several differences, however.

In this second embodiment the plunger does not have a generally uniform thickness. Additionally, the transition portion 42 includes a plurality of peripheral, radially outward extending projections 110. These projections do not seal against the interior of the sidewall, but may serve a function described more fully below. A further difference is the configuration of peripheral ribs 46'. In the first embodiment the ribs 46 had a relatively small radial projection, and were relatively angular at their exterior. In this embodiment, the ribs 46' are more pronounced radially, and have a much more rounded apex. As a result, the ribs 46' will provide the majority of the contact with the sidewall, with the skirt having little or no such contact. As will be clear, there is much less need to provide a full seal with the plunger in this embodiment, and therefore the ribs 46' provide a sufficient seal.

As noted above, the plunger of the second embodiment differs from the first by having the ring groove 108. As noted, the ring groove receives the interior hook 104 of the second ring, thus serving to more securely retain the plunger in its initial position. This of course reduces the possibility of inadvertent movement of the plunger and dispensing of the material.

Also as with the first embodiment, the end rings (actually the second end ring 100) serve to retain the cap 86 in position. This is performed in a manner similar to the first embodiment, with the skirt of the cap being placed in interference with the end ring.

The cap of the second embodiment is generally similar to that of the first. One difference between the cap of the first and the second embodiment, however, is the seal for the nozzle. In this embodiment there is provided a tamper evident lid 112 similar to those used on milk jugs. In a manner similar to milk jugs, there may additionally be provided a liner (not shown) under the lid and secured to the upper edge of the nozzle. This arrangement eliminates the need for a separate punch out, although the punchout could still be provided.

This second embodiment differs most from the first in the provision of an interior bag 113. This bag is formed of a liquid, and preferably gas, impermeable material, typically a flexible thermoplastic. The bag will include a sidewall 114 having an upper edge 115, with the sidewall defining an interior cavity 116. The upper edge 115 in turn defines an opening 118 providing access to the interior cavity 116. The bag may be of the type formed by simply folding over a sheet of material, or simply placing two sheets of material in overlying arrangement (with appropriate edge seals of course). When filled, such known bag arrangements provide a good cylindrical sidewall near the opening, but result in two outwardly pointing cones at a bottom 120 of the bag. To provide a bag with a more truly cylindrical configuration, and in particular a more circular bottom, upon filling, the bag 113 may be formed with pleats or other panels which provide a well defined bottom 120. This may be preferred to more closely conform to the interior of the container.

As is shown in FIGS. 6 and 7, the bag 113 will be received within the cavity of the container with the bottom of the bag adjacent the upper face of the plunger, and the sidewall 114 adjacent the interior 96 of the sidewall 82. This will result in the opening 118 being adjacent the cap. The upper edge 115 will then be folded over the second end of the sidewall such that the upper edge is placed adjacent the exterior 94 of the sidewall 82. This results in the portion of the bag remaining within the interior of the container closely conforming to the interior.

The bag 113 is secured in this position by one of two methods. In the first method, the bag is placed into the container prior to the application of the second end ring 100. When the second end ring is then secured to the second end of the sidewall the second end ring will thus overly the bag and secure it in place. This is shown in FIG. 7. As may be readily envisioned, the use of the hook 104 and groove 106 at the second end serves to more securely retain the bag sidewall. In addition, it is preferred that the upper edge 115 of the bag, in the assembled position, extend below the level of the exterior ring groove 32. This will result in the bag sidewall being again locked in position by the hook-and-groove combination.

The second method of retaining the bag in position is to place the bag within the container after application of the second end ring but prior to the application of the cap 86. In this arrangement, shown in FIG. 8, the bag is simply retained in position by the tight fit of the cap skirt over the second end ring.

The first method of bag securement, with the sidewall intermediate the end ring and the sidewall is believed to be more secure, yet it may be more difficult to maintain the bag sidewall in the proper position during application of the ring. The second method, where the bag is intermediate the end ring and the cap, may be less secure than the first method, but is more simple in its application. Both methods are believed to adequately secure the bag in position for most application of the container.

As may be envisioned, the material to be packaged will be placed within the cavity 116, typically prior to application of the cap 86. The impermeable nature of the bag will thus retain the material and assist in preventing leakage from the container. The seal of the container at the second end is, as in the first embodiment, provided by a tight fit of the lid skirt over the second end ring. At the first end, however, the sealing function of the plunger against the sidewall is much less important than in the first embodiment. Here, the bag of course serves to prevent ingress or egress at the first end.

In operation, the plunger will be moved toward the second end in a manner similar to the first embodiment. This movement will serve to collapse the bag, thus forcing the material within the bag to be ejected from the nozzle in the cap. The surface area of the bag will of course not be reduced by any appreciable extent during the movement of the plunger. As such, folds of the bag material, typically the sidewall 114, will form with more and more plunger movement.

The plunger design of this second embodiment is believed to provide an advantageous effect upon these bag folds. As may be envisioned, the bottom 120 of the bag will typically remain in a stretched condition over the face of the plunger, while most of the bag folds are formed near the intersection of the sidewall and the plunger. The projections 110 may serve to prevent movement of the bag peripherally inward to thus maintain the stretched condition of the bag bottom. The folds may thus be confined to the transition portion, reducing the volume encompassed by the fold. This will help to ensure that little of the material within the bag is trapped in such folds, increasing the amount of material which may be dispensed and reducing waste.

As an alterative, the fit of the plunger within the sidewall could be tailored such that upon movement of the plunger the bag will pass between the plunger skirt and the sidewall, folding the bag against itself. In such an arrangement the projections 110 would again serve to maintain the taught condition of the bag bottom against the plunger, but the ribs 46' would again serve a wiping action (transferred through the bag portion immediately overlying the ribs) against the interior of the bag sidewall. This would serve to reduce the waste of material remaining within the bag, although the folded-over bag portion extending back from the edge of the plunger skirt could be damaged and provide an ingress/egress location.

A further consideration with this second embodiment is the final position of the plunger. In this embodiment, it is recalled, the tapers 102 are provided. As a result, the interior diameter of the sidewall is reduced adjacent the second end where the plunger will come to rest. The transition portion may have an angle similar to that of the taper such that a mating action is provided similar to that of the first embodiment. However, there will typically not be any actual mating between the plunger and the bottom face of the cap 86. As such, and as is shown in FIG. 7, the sealing lip 74 of the second embodiment may be reduced to a size simply sufficient for sealing the cap, with little or no regard for mating with the plunger. This mating could, alternatively, still be achieved, as inferred from the sealing lip configuration of FIG. 8.

From the above description it may be seen that the container according to the present invention may be manufactured with low cost, will provide excellent sealing capabilities to maintain the product in a fresh condition, and will reliable dispense a maximum amount of contents.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. Various features of the embodiments may additionally be interchanged, such as providing the tapers upon the sidewall of the first embodiment, without the use of the bag. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A dispensing container, comprising:

at least one peripheral side wall;

a plunger located at a first end of said at least one side wall, said plunger having an outer periphery in close sliding contact with an interior face of said side wall and being capable of movement toward a second end of said side wall, said plunger including a transition portion extending from a center portion radially outward toward said interior face of the side wall and downward toward said first end;

a cap located at a second end of said side wall and including an opening for the contents of the container to pass therethrough during said movement of said plunger;

a flexible bag having a flexible bottom and flexible sidewall defining, and an opening leading to, a closed cavity defined therein, at least a portion of said bag being located within said at least one peripheral side wall; and a fold confining area located between said transition portion and the interior face of said side wall, said transition portion confining folds of the bag to said fold confining area as the plunger is moved toward said second end.

2. A container as in claim 1, wherein said plunger includes at least one rib about a periphery thereof.

3. A container as in claim 1, wherein said at least one peripheral side wall includes a first end ring extending about the periphery of said first end, said plunger including a skirt located intermediate a portion of said end ring and said side wall in an initial position prior to said movement of said plunger.

4. A container as in claim 3, wherein said at least one peripheral side wall further includes a second end ring extending about the periphery of said second end, said cap being connected to said end ring.

5. A container as in claim 4, wherein said sidewall of said bag is intermediate said end ring and said peripheral sidewall.

6. A container as in claim 5, wherein said cap includes a peripheral skirt extending toward said first end and located peripherally outward of said second end ring, said skirt including a portion adjacent said second end ring, and between said first end second end rings, extending peripherally inward with respect to an outermost segment of said second end ring, whereby said portion retains said cap on said end ring and thus said side wall.

7. A container as in claim 6, wherein said cap further includes a peripherally extending sealing lip extending toward said first end and located peripherally inside, but in close proximity to, said second ring.

8. A container as in claim 7, wherein said cap, including said skirt and sealing lip, is a monolithic unit.

9. A container as in claim 7, wherein an underside of said cap, including said sealing lip, substantially conforms to an upper side of said plunger, whereby said plunger and said cap substantially mate when said plunger has completed said movement to minimize the volume within said container.

10. A container as in claim 4, wherein said sidewall of said bag is intermediate said end ring and said peripheral sidewall.

11. A container as in claim 10, wherein said cap includes a peripheral skirt extending toward said first end and located peripherally outward of said second end ring, said skirt including a portion adjacent said second end ring, and between said first end second end rings, extending peripherally inward with respect to an outermost segment of said second end ring, whereby said portion retains said cap on said end ring and thus said side wall.

12. A container as in claim 11, wherein said cap further includes a peripherally extending sealing lip extending toward said first end and located peripherally inside, but in close proximity to, said second ring.

13. A container as in claim 12, wherein said cap, including said skirt and sealing lip, is a monolithic unit.

14. A container as in claim 12, wherein an underside of said cap, including said sealing lip, substantially conforms to an upper side of said plunger, whereby said plunger and said cap substantially mate when said plunger has completed said movement to minimize the volume within said container.

15. A container as in claim 1, wherein said center portion of said plunger is domed shaped and includes an outer periphery connected to the transition portion, said plunger being concave shaped toward said first end.

16. A container as in claim 1, further comprising at least one peripheral projection formed upon said transition portion and radially extending outward toward said sidewall, said projections engaging a bottom of said bag and maintaining said bottom in a stretched condition over the plunger.

17. A container as in claim 1, wherein said plunger further comprises:

means for preventing movement of a bottom of said bag peripherally inward and for maintaining said bottom in a stretched condition while the plunger is moved toward said second end.

18. A container as in claim 1, wherein said plunger further comprises a skirt formed on a lower end of said transition portion, said skirt extending downward toward said first end.

19. A dispensing container, comprising:

at least one peripheral side wall;

a plunger located at a first end of said at least one side wall, said plunger having an outer periphery in close sliding contact with an interior face of said side wall and being capable of movement toward a second end of said side wall;

a cap located at a second end of said side wall and including an opening for the contents of the container to pass therethrough during said movement of said plunger, said cap being retained upon said second end by mechanical interference with said second end; and a flexible bag having a side wall defining, and an opening leading to, a closed cavity defined therein, at least a portion of said bag being located within said at least one peripheral side wall, with said side wall of said bag being folded over said second end of said at least one peripheral side wall and being at a position intermediate said cap and said second end of said at least one peripheral side wall, said at least one peripheral side wall includes a first end ring extending about the periphery of said first end, said plunger including a skirt located intermediate a portion of said end ring and said side wall in an initial position prior to said movement of said plunger.

20. A container as in claim 19, wherein said at least one peripheral side wall further includes a second end ring extending about the periphery of said second end, said cap being connected to said end ring.

21. A dispensing container, comprising:

at least one peripheral side wall;

a plunger located at a first end of said at least one side wall, said plunger having an outer periphery in close sliding contact with an interior face of said side wall and being capable of movement toward a second end of said side wall;

a cap located at a second end of said side wall and including an opening for the contents of the container to pass therethrough during said movement of said plunger, said cap being retained upon said second end by mechanical interference with said second end; and a flexible bag having a side wall defining, and an opening leading to, a closed cavity defined therein, at least a portion of said bag being located within said at least one peripheral side wall, with said side wall of said bag being folded over said second end of said at least one peripheral side wall and being at a position intermediate said cap and said second end of said at least one peripheral side wall, said at least one peripheral side wall includes a first end ring extending about the periphery of said first end, said plunger including a skirt located intermediate a portion of said end ring and said side wall in an initial position prior to said movement of said plunger, said sidewall of said bag being located intermediate said end ring and said peripheral side wall.

* * * * *